US007997111B2

(12) United States Patent
Mercer et al.

(10) Patent No.: US 7,997,111 B2
(45) Date of Patent: Aug. 16, 2011

(54) APPARATUS FOR ROTATING A CONTAINER BODY

(75) Inventors: Richard Mercer, North Yorkshire (GB); David William Smith, Keighley (GB)

(73) Assignee: Crown, Packaging Technology, Inc., Alsip, IL (US)

( * ) Notice: Subject to any disclaimer, the term of this patent is extended or adjusted under 35 U.S.C. 154(b) by 0 days.

(21) Appl. No.: 12/109,031

(22) Filed: Apr. 24, 2008

(65) Prior Publication Data

US 2009/0266128 A1 Oct. 29, 2009

(51) Int. Cl.
*B21D 51/26* (2006.01)
*B21J 11/00* (2006.01)

(52) U.S. Cl. ..... 72/94; 72/405.03

(58) Field of Classification Search ..... 72/94, 379.4, 72/405.03; 198/377, 377.1, 377.01, 379, 198/384–385
See application file for complete search history.

(56) References Cited

U.S. PATENT DOCUMENTS

| | | | |
|---|---|---|---|
| 137,400 | A | 4/1873 | Ahrend |
| 548,888 | A | 10/1895 | Noteman |
| 593,755 | A | 11/1897 | Pond et al. |
| 1,459,584 | A | 6/1923 | Ericsson |
| 1,498,940 | A | 6/1924 | Wheeler |
| 1,621,301 | A | 3/1927 | Wright |
| 2,467,278 | A | 4/1949 | Thompson |
| 2,550,156 | A | 4/1951 | Lyon |
| 2,686,551 | A | 8/1954 | Laxo |
| 2,874,562 | A | 2/1959 | Cross |
| 2,928,454 | A | 3/1960 | Laxo |
| 2,940,502 | A | 6/1960 | La |
| 3,096,709 | A | 7/1963 | Eldred et al. |
| 3,143,366 | A | 8/1964 | Nichols |
| 3,268,054 | A | 8/1966 | Murphy et al. |
| 3,344,685 | A | 10/1967 | Crouzet |
| 3,374,684 | A | 3/1968 | Greven |
| 3,406,648 | A | 10/1968 | David |
| 3,418,837 | A | 12/1968 | Vanderlaan et al. |
| 3,599,780 | A | 8/1971 | Sorbie |

(Continued)

FOREIGN PATENT DOCUMENTS

| | | |
|---|---|---|
| CA | 2536841 | 2/2006 |

(Continued)

OTHER PUBLICATIONS

U.S. Appl. No. 11/643,935, filed Dec. 22, 2006, Shortridge et al.

*Primary Examiner* — Edward Tolan
*Assistant Examiner* — Mohammad Yusuf
(74) *Attorney, Agent, or Firm* — Woodcock Washburn LLP

(57) ABSTRACT

An apparatus for rotating a container body that utilizes frictional forces rather than the engagement of gears to rotate the container body is provided. Such an apparatus may include a stationary housing and a turret rotating on a shaft proximate to the housing. The turret may have a plurality of pockets and a roller assembly disposed within each pocket. Each roller assembly may have a body portion and a drive roller portion. Each body portion may have a contact portion for contacting a container body received in a respective pocket. Each drive roller may be in contact with the housing such that as the turret rotates, friction between the drive rollers and the housing causes each roller assembly to rotate.

21 Claims, 7 Drawing Sheets

U.S. PATENT DOCUMENTS 3,621,530 A 11/1971 Pflieger et al.
3,635,069 A 1/1972 Eickenhorst
3,659,443 A 5/1972 Ball
3,687,098 A 8/1972 Maytag
3,797,429 A 3/1974 Wolfe
3,983,729 A 10/1976 Traczyk et al.
4,030,432 A 6/1977 Miller et al.
4,164,997 A 8/1979 Mueller
4,341,103 A 7/1982 Escallon et al.
4,457,160 A 7/1984 Wünsch
4,513,595 A 4/1985 Cvacho
4,519,232 A 5/1985 Traczyk et al.
4,576,024 A 3/1986 Weber
4,590,788 A 5/1986 Wallis
4,624,098 A 11/1986 Trendel
4,671,093 A 6/1987 Dominico et al.
4,685,556 A * 8/1987 Joseph ..... 198/787
4,693,108 A 9/1987 Traczyk et al.
4,732,027 A 3/1988 Traczyk et al.
4,773,250 A 9/1988 Miyazaki
4,817,409 A 4/1989 Bauermeister
4,838,064 A 6/1989 Paess
4,892,184 A 1/1990 Vander Griendt et al.
4,945,954 A 8/1990 Wehrly et al.
5,105,649 A 4/1992 Hite et al.
5,209,101 A 5/1993 Finzer
5,226,303 A 7/1993 Dieden et al.
5,235,839 A 8/1993 Lee, Jr. et al.
5,245,848 A 9/1993 Lee, Jr. et al.
5,282,375 A 2/1994 Lee, Jr. et al.
5,301,530 A * 4/1994 Beelen et al. ..... 72/149
5,349,836 A 9/1994 Lee, Jr.
5,353,619 A 10/1994 Chu et al.
5,370,472 A 12/1994 Muellenberg
5,467,628 A 11/1995 Bowlin et al.
5,469,729 A 11/1995 Hager
5,540,320 A 7/1996 Sarto et al.
5,553,826 A 9/1996 Schultz
5,611,231 A 3/1997 Marritt et al.
5,634,364 A 6/1997 Gardner et al.
5,676,006 A 10/1997 Marshall
5,713,235 A 2/1998 Diekhoff
5,724,848 A 3/1998 Aschberger
5,755,130 A 5/1998 Tung et al.
5,778,722 A * 7/1998 Saiki et al. ..... 72/347
5,782,308 A 7/1998 Latten et al.
5,882,178 A 3/1999 Hudson et al.
5,906,120 A 5/1999 Thacker et al.
6,032,502 A 3/2000 Halasz et al.
6,055,836 A 5/2000 Waterworth et al.
6,085,563 A 7/2000 Heiberger et al.
6,094,961 A 8/2000 Aschberger
6,164,109 A 12/2000 Bartosch
6,167,743 B1 1/2001 Marritt et al.
6,176,006 B1 1/2001 Milliman
6,178,797 B1 1/2001 Marshall et al.
6,199,420 B1 3/2001 Bartosch
6,240,760 B1 6/2001 Heiberger et al.
6,571,986 B1 6/2003 Simmons
6,644,083 B2 11/2003 Pakker
6,658,913 B1 12/2003 Zanzerl et al.
6,661,020 B2 12/2003 Schill et al.
6,672,122 B2 1/2004 Mustread et al.
6,698,265 B1 3/2004 Thomas
6,752,000 B2 6/2004 Reynolds et al.
6,779,651 B1 8/2004 Linglet et al.
6,899,358 B2 * 5/2005 Richardson ..... 285/354
6,902,107 B2 * 6/2005 Shay et al. ..... 235/381
7,028,857 B2 4/2006 Peronek
7,069,765 B2 7/2006 Grove et al.
7,100,417 B2 9/2006 Yamanaka et al.
2002/0029599 A1 3/2002 Heiberger
2002/0148266 A1 10/2002 Heiberger et al.
2004/0069027 A1 4/2004 Fukushima
2005/0193796 A1 9/2005 Heiberger et al.
2006/0101884 A1 5/2006 Schill et al.
2006/0101885 A1 5/2006 Schill et al.
2006/0101889 A1 5/2006 Schill et al.
2006/0104745 A1 5/2006 Schill et al.
2007/0227218 A1 10/2007 Shortridge
2007/0227320 A1 10/2007 Marshall
2007/0227859 A1 10/2007 Marshall et al.
2007/0249424 A1 10/2007 Marshall et al.
2007/0251803 A1 11/2007 Schill et al.
2007/0283544 A1 12/2007 Schill et al.
2007/0283665 A1 12/2007 Schill et al.

FOREIGN PATENT DOCUMENTS

DE 19 39 623 A1 2/1970
DE 101 56 085 A1 5/2003
EP 0 885 076 7/2002
FR 2 881 123 A1 7/2006
GB 189707306 3/1898
GB 2173437 A 10/1986
JP 2002 102968 4/2002
JP 2003-237752 8/2003
JP 2003 251424 9/2003
JP 2003-252321 9/2003
JP 2003320432 11/2003
JP 2004-002557 1/2004
JP 2004-130386 4/2004
JP 2004160468 6/2004
JP 2004-217305 8/2004
JP 2005-022663 1/2005
JP 2006-176140 7/2006
JP 2006-176183 7/2006
WO WO 94/12412 6/1994
WO WO 97/37786 A1 10/1997
WO WO 97/49509 12/1997
WO WO 00/23212 A 4/2000
WO WO 2006/055185 A 5/2006
WO WO 2006/067207 6/2006
WO WO 2006/067901 6/2006

* cited by examiner

APPARATUS FOR ROTATING A CONTAINER BODY

CROSS REFERENCE TO RELATED APPLICATIONS

This application is related by subject matter to the inventions disclosed in the following commonly assigned applications, each of which is filed on even date herewith: U.S. patent application Ser. No. 12/108,950 entitled "Adjustable Transfer Assembly For Container Manufacturing Process", U.S. patent application Ser. No. 12/109,058 entitled "Distributed Drives For A Multi-Stage Can Necking Machine", U.S. patent application Ser. No. 12/108,926 and entitled "Container Manufacturing Process Having Front-End Winder Assembly", U.S. patent application Ser. No. 12/109,131 and entitled "Systems And Methods For Monitoring And Controlling A Can Necking Process" and U.S. patent application Ser. No. 12/109,176 entitled "High Speed Necking Configuration." The disclosure of each application is incorporated by reference herein in its entirety.

FIELD OF THE TECHNOLOGY

The present technology relates to apparatuses for manufacturing containers. More particularly, the present technology relates to apparatuses for rotating container bodies as the containers are being manufactured.

BACKGROUND

Metal beverage cans are designed and manufactured to withstand high internal pressure—typically 90 or 100 psi. Can bodies are commonly formed from a metal blank that is first drawn into a cup. The bottom of the cup is formed into a dome and a standing ring, and the sides of the cup are ironed to a desired can wall thickness and height. After the can is filled, a can end is placed onto the open can end and affixed with a seaming process.

It has been the conventional practice to reduce the diameter at the top of the can to reduce the weight of the can end in a process referred to as necking. Cans may be necked in a "spin necking" process in which cans are rotated with rollers that reduce the diameter of the neck. Most cans are necked in a "die necking" process in which cans are longitudinally pushed into dies to gently reduce the neck diameter over several stages. For example, reducing the diameter of a can neck from a conventional body diameter of $2^{11}/_{16}{}^{th}$ inches to $2^{6}/_{16}{}^{th}$ inches (that is, from a 211 to a 206 size) often requires multiple stages, often 14.

Each of the necking stages typically includes a main turret shaft that carries a starwheel for holding the can bodies, a die assembly that includes the tooling for reducing the diameter of the open end of the can, and a pusher ram to push the can into the die tooling. Each necking stage also typically includes a transfer starwheel to transfer cans between turret starwheels. Often, a waxer station is positioned at the inlet of the necking stages, and a bottom reforming station, a flanging station and a light testing station are positioned at the outlet of the necking stages.

The waxer station is positioned at the inlet of the necking stages and coats an open end of can bodies with a lubricant to prepare the can bodies for necking. Typical waxer stations include a starwheel mounted on a rotating shaft and having a plurality of pockets (for example 12 pockets is common) formed therein. Each pocket is adapted to receive a can body from an input chute as the starwheel rotates. Each pocket typically includes two can rollers that rotate the can bodies as the starwheel rotates. Thus, the can bodies rotate within each pocket as the starwheel rotates. Such rotation allows the entire open end of each can body to be lubricated as the can bodies pass a lubricating station.

To rotate the can bodies, each can roller includes a gear that meshes with gear teeth extending from a housing positioned proximate to the starwheel. As the starwheel rotates, the gears of the can rollers engage the gear teeth of the housing thereby causing the can rollers to rotate.

During the waxing process, debris may be lodged between the gear teeth of the can rollers and housing. As a result, the gear teeth may fracture, thus requiring an operator to either change the gears of every can roller or change the housing. Such tasks are time consuming and may be costly to the manufacturer.

SUMMARY

An apparatus for rotating a container body that utilizes frictional forces rather than the engagement of gears to rotate the container body is provided. Such an apparatus may be a waxer assembly used in a multi-stage can necking machine.

For example, such an apparatus may include a housing, a turret mounted on a rotating shaft, and a lubricating station. The housing may be mounted on shaft or concentric to the shaft, and may have a peripheral surface. The turret may include a peripheral pocket formed therein. The pocket may be adapted to receive a container body and may include a roller assembly. The roller assembly may include a body portion and a drive roller extending from the body portion. A contact portion of the body portion may be positioned within the pocket such that the contact portion may be adapted to contact an outer surface of the can body that is received in the pocket. The driver roller that extends from the body portion may be in contact with the peripheral surface of the housing such that as the turret rotates, friction between the drive roller and the peripheral surface of the housing causes the roller assembly to rotate. A lubricating station may also be positioned proximate to the turret and may lubricate an open end of the can body as the turret rotates about the shaft.

In some embodiments, the peripheral surface of the housing may include an O-ring and the drive roller may be in contact with the O-ring such that as the waxer turret rotates, friction between the drive roller and the O-ring causes the can roller to rotate. In a preferred embodiment, the O-ring is made of rubber and is removeably attached to the peripheral surface of the housing. For example, the peripheral surface of the housing may include a groove formed between a first wall extending from a body of the housing and a second wall extending from the body of the housing, and the O-ring may be removeably secured within the groove.

DETAILED DESCRIPTION OF ILLUSTRATIVE EMBODIMENTS

A preferred structure for rotating a container body is described herein. An embodiment of a waxer for a multi-stage can necking machine that employs this technology is also described. The present invention is not limited to the disclosed configuration of waxer or can necking machine, but rather encompasses use of the technology disclosed in any container manufacturing application according to the language of the claims.

Figure 1:
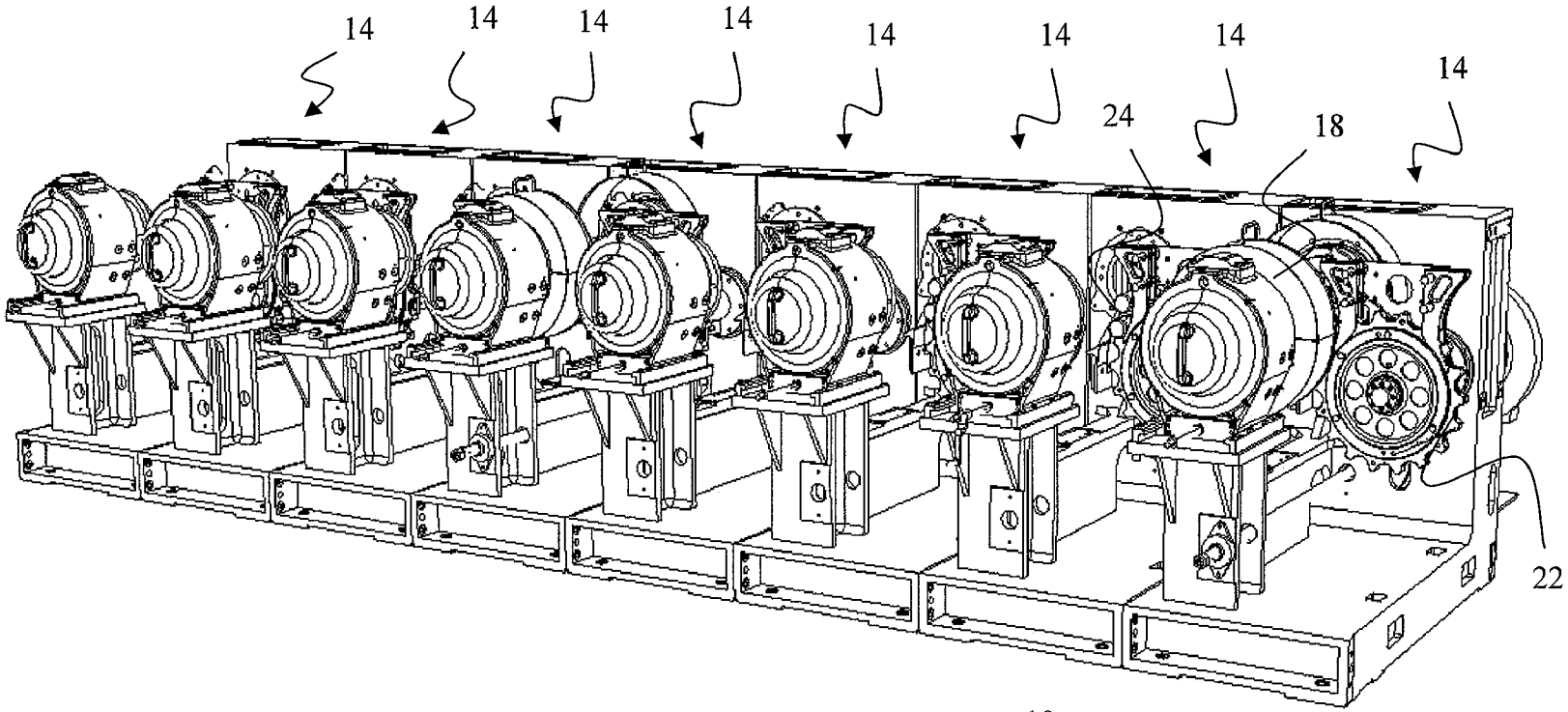
FIG. 1 is a perspective view depicting a multi-stage can necking machine.
Figure 2:
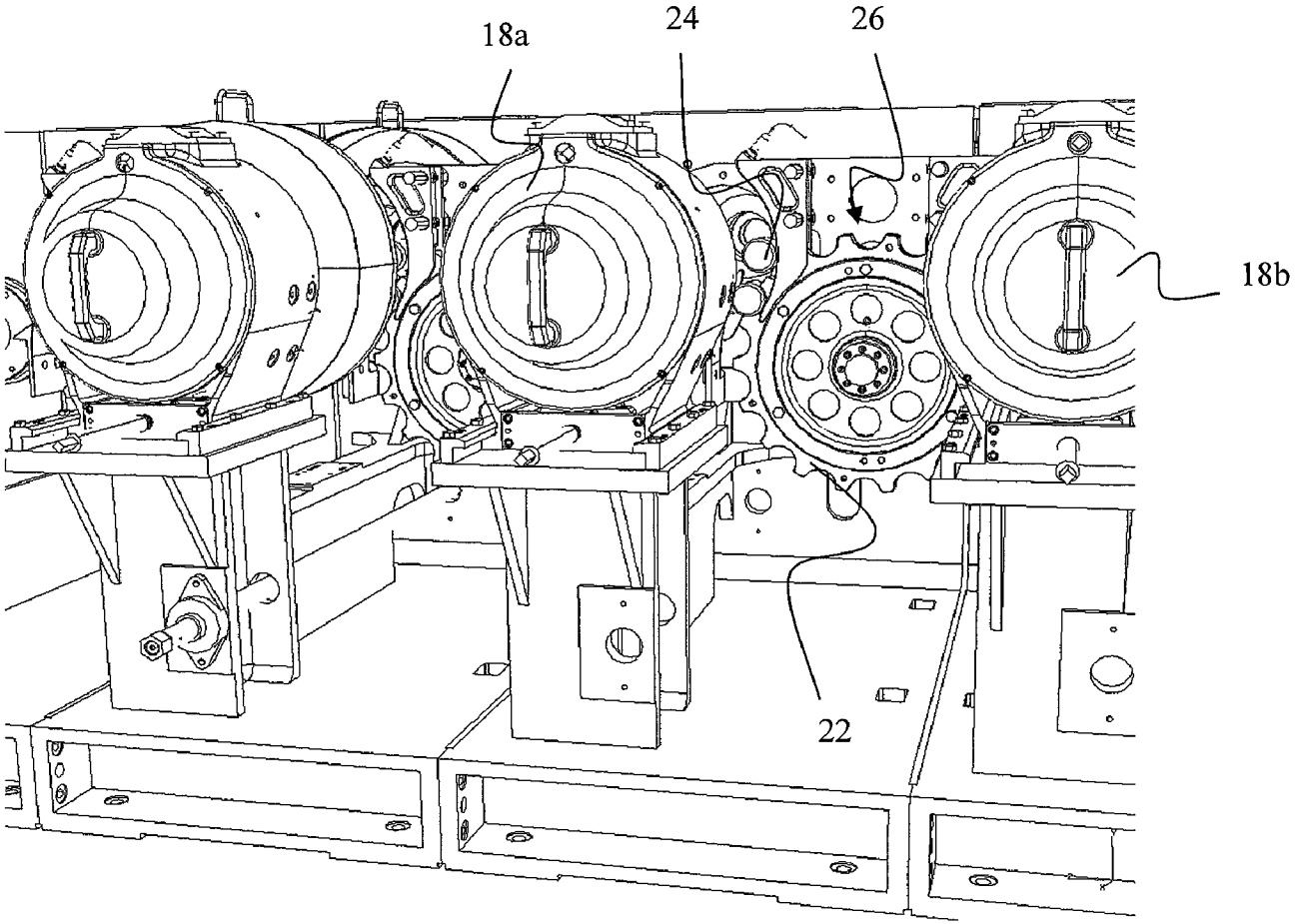
FIG. 2 is a partial expanded view depicting a section of the multi-stage can necking machine shown in FIG. 1.

As shown in FIGS. 1 and 2, a multi-stage can necking machine 10 may include several necking stages 14. Each necking stage 14 includes a necking station 18 and a transfer starwheel 22. The necking stations 18 are adapted to incrementally reduce the diameter of an open end of a can body 24, and the transfer starwheels 22 are adapted to transfer the can body 24 between adjacent necking stations 18.

Each necking station 18 includes a turret having a plurality of pockets formed therein. Each pocket is adapted to receive the can body 24 and securely holds the can body 24 in place by mechanical means and compressed air, as is understood in the art. Using techniques well known in the art of can making, an open end of the can body 24 is brought into contact with a die by a pusher ram as the turret carries the can body 24 through an arc along a top portion of the necking station 18. The inside of a typical die is typically designed, in longitudinal cross section, to have a lower (that is, outboard) cylindrical surface with a nominal dimension capable of receiving the can body 24, a curved transition zone, and a reduced diameter upper cylindrical surface above the transition zone. During the necking operation, the can body 24 is moved into the die such that the open end of the can body 24 is placed into touching contact with the transition zone of the die. As the can body 24 is moved further upward into the die, the upper region of the can body is forced past the transition zone into a snug position between the inner reduced diameter surface of the die and a form control member or sleeve located at the lower portion of the punch. The diameter of the upper region of the can is thereby given a reduced dimension by the die. A curvature is formed in the can wall corresponding to the surface configuration of the transition zone of the die. The can is then pushed out of the die.

As shown in FIG. 2, after the diameter of the end of the can body 24 has been reduced by a first necking station 18*a* the turret deposits the can body 24 into a pocket 26 of the transfer starwheel 22. The pocket 26 is adapted to receive the can body 24 and retains the can body 24 using a vacuum force. The transfer starwheel 22 then carries the can body 24 through an arc on the lower portion of starwheel 22, and deposits the can body 24 into one of the pockets of the turret of an adjacent necking station 18*b*. The necking station 18*b* further reduces the diameter of the end of the can body 24 in a manner substantially identical to that noted above.

The can body 24 may be passed through any number of necking stations 18 depending on the desired diameter of the open end of the can body 24. For example, multi-stage can necking machine 10 shown in the figures includes eight stages 14, and each stage incrementally reduces the diameter of the open end of the can body 24 as described above.

Figure 3:
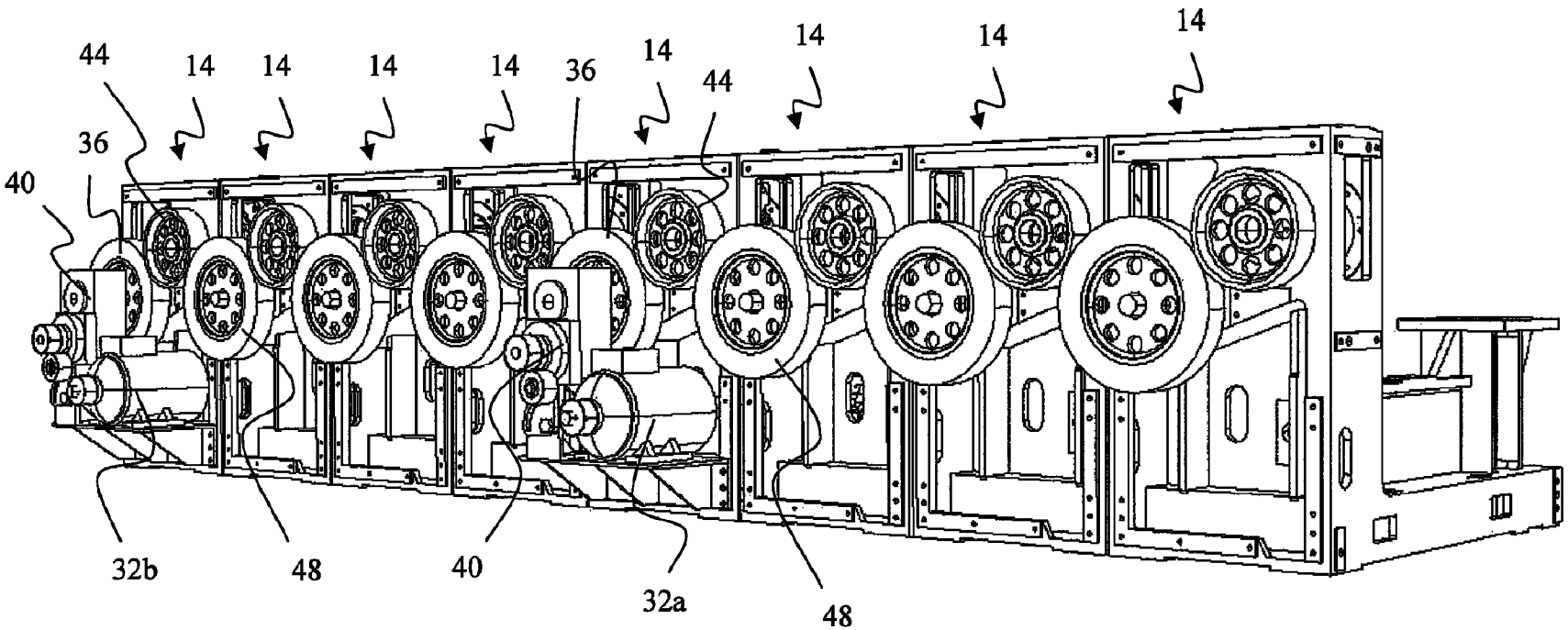
FIG. 3 is a perspective view depicting a back side of a multi-stage can necking machine.

As shown in FIG. 3, the multi-stage can necking machine 10 may include several motors 32 to drive the starwheels and turrets of each necking stage 14. As shown, there may be one motor 32 per every four necking stages 14.

Each motor 32 is coupled to and drives a first gear 36 by way of a gear box 40. The motor driven gear 36 then drives an adjacent second gear 44 which in turn drives a third gear 48 and so on. As shown, motor 32*a* drives the gears of four necking stages 14 and motor 32*b* drives the gears of the remaining four necking stages 14. The gears of the turrets and transfer starwheels are engaged in a continuous gear train.

Conventional multi-stage can necking machines, in general, include an input station and a waxer station at an inlet of the necking stages, and a bottom reforming station, a flanging station and a light testing station positioned at an outlet of the necking stages. Accordingly, multi-stage can necking machine 10, may include in addition to necking stages 14, an input station, a bottom reforming station, a flanging station, and a light testing station. The input station, bottom reforming station, flanging station, and light testing stations (not shown in the figures) may be conventional. Machine 10 may also include a waxer assembly 50.

Shown in FIGS. 4-7 is an example waxer assembly 50 that may be coupled to an inlet of a multi-stage can necking machine. As shown, the waxer assembly 50 includes an input station 54 and a waxer station 58 adjacent to and in communication with the input station 54.

The input station 54 includes an input starwheel 62 mounted on a rotating shaft 66 and an input chute 68. As shown, the input starwheel 62 includes a plurality of pockets 72 formed therein, each pocket 72 being adapted for receiving a can body. As the input starwheel 62 rotates, each pocket 72 receives a can body from the input chute 68. The input starwheel 62 then rotates and delivers the can body to the waxer station 58. The input station 54 preferably delivers up to 3400 cans per minute to the waxer station 58.

Figure 4:
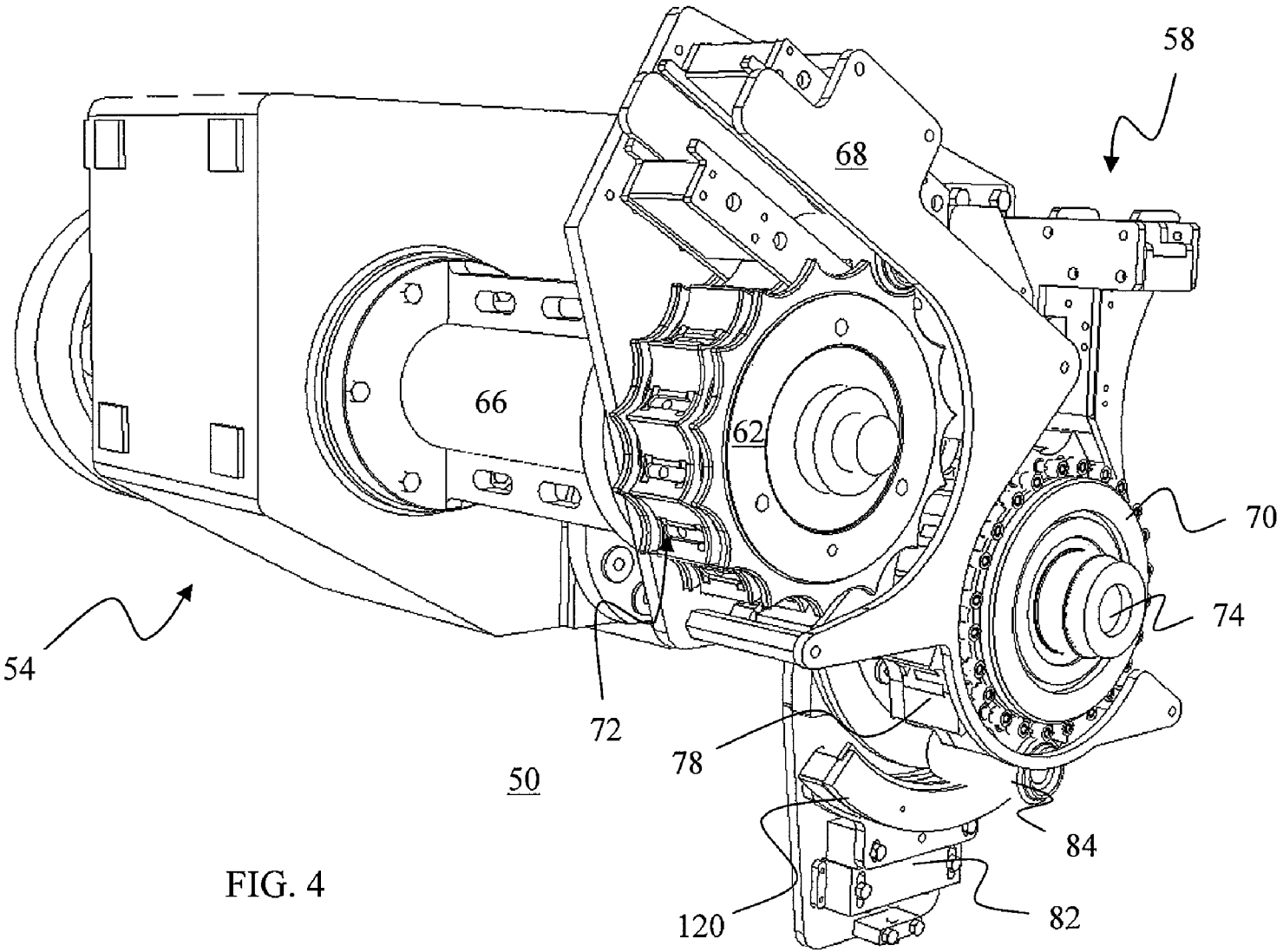
FIG. 4 is a perspective view depicting a waxer assembly.

As shown in FIG. 4, the waxer station 58 includes a housing 70 mounted on or concentric to a rotating shaft 74, a turret 78 mounted on the shaft 74, and a lubricating station 82 mounted proximate to the turret 78. The waxer station 58 lubricates an open end of a can body 84 in preparation for the necking stages to follow.

Figure 5:
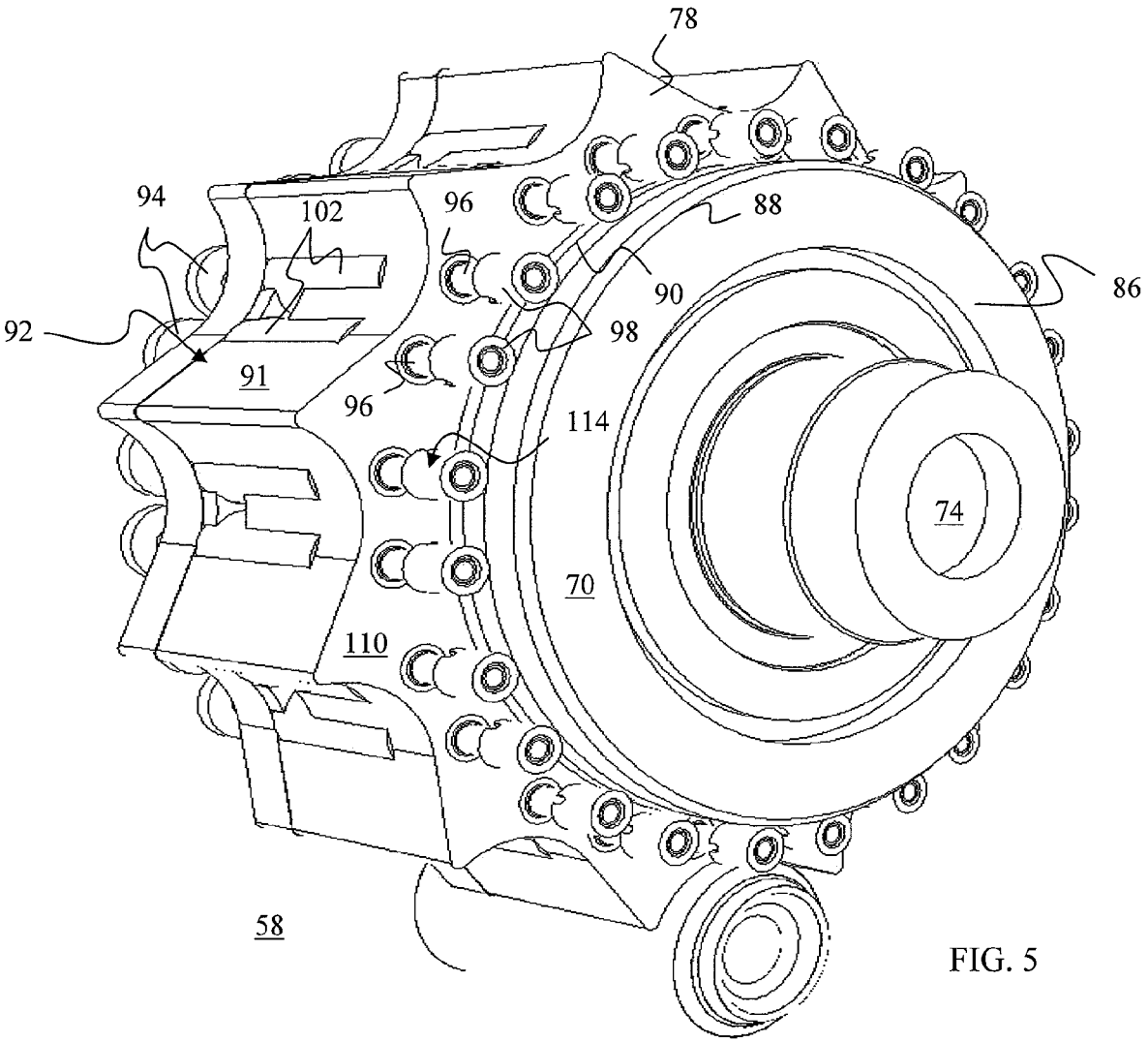
FIG. 5 is a perspective view depicting the waxer assembly with the lubricating station and input station removed.

As shown in FIG. 5, the housing 70 includes a housing body 86 and a peripheral surface 88. As shown, the housing body 86 may be fastened to the shaft 74 such that housing 70 remains stationary as the turret 78 and the shaft 74 rotate. The peripheral surface 88 of the housing 70 preferably includes an O-ring 90. The O-ring 90 may be made from a variety of materials. For example, the O-ring 90 may be made of rubber or other conventional O-ring material, and preferably is resilient. The O-ring may be circular in transverse cross section, however, is not limited to such a shape.

As shown in FIG. 5, the turret 78 is mounted on the shaft 74 proximate to the housing 70. The turret 78 includes a plurality of curved surfaces 91 that define pockets 92 formed therein, wherein each pocket 92 is adapted to receive a can body from the input starwheel 62 of the input station 54. The can bodies are retained in each pocket 92 using a vacuum force from a central vacuum source. The connection of the vacuum source to pockets 92 may be as generally described in co-pending application Ser. No. 12/108,926, filed concurrently herewith) or may be by conventional means, as will be understood by persons familiar with can necking and waxer equipment and processes. As the turret 78 rotates, the can bodies are carried through an arc and delivered to a turret of a first necking stage at the end of the arc. While the can bodies are carried through the arc, the open ends of the can bodies are lubricated by the lubricating station 82.

Figure 6:
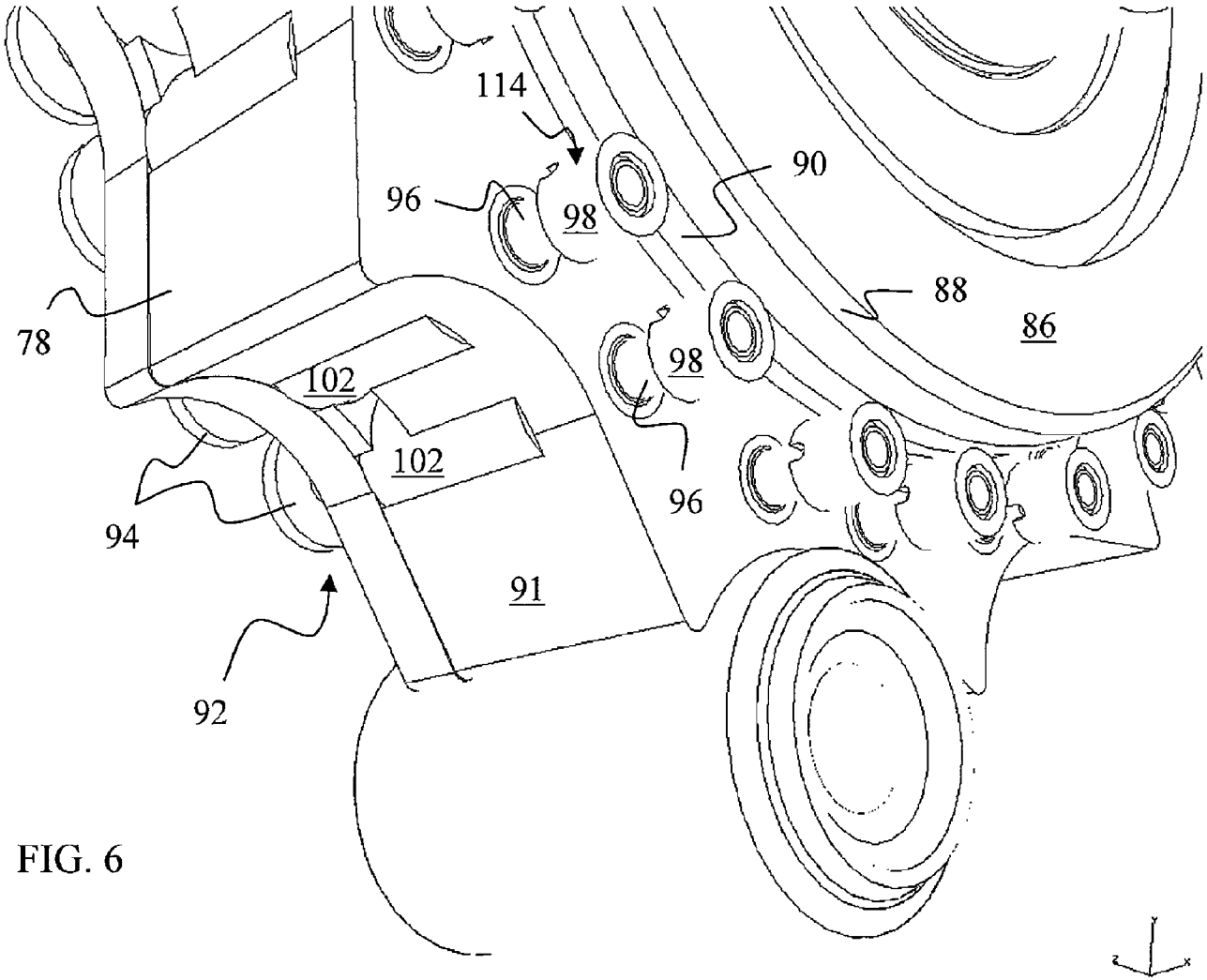
FIG. 6 is an a partial expanded view of the waxer assembly of FIG. 5.

As shown in FIGS. 5 and 6, each pocket 92 includes two roller assemblies 94 rotateably mounted therein. Each roller assembly 94 includes a body portion 96 and a drive roller 98 extending from the body portion 96. Each body portion 96 has a contact portion 102 that protrudes through surface 91 of a respective pocket 92. The contact portions 102 are adapted to contact the surface of a can body. Because each pocket 92 preferably includes two roller assemblies 94, each can body will have a surface that is in contact with a contact portion 102 of two separate roller assemblies 94. As the turret 78 rotates, each roller assembly 94 will rotate within its respective pocket 92. Therefore, as the roller assemblies 94 rotate within their pockets 92, frictional forces between the roller contact portions 102 and the surface of the can bodies retained in the pockets 92 will enable the can bodies to rotate within each pocket 92 as the turret 78 rotates.

The roller assemblies 94 are driven using frictional contact between the drive rollers 98 and the housing 70. As shown, each drive roller 98 extends from a respective body portion 96 and protrudes from a side surface 110 of the turret 78. Each drive roller 98 has a surface 114 that is in contact with the peripheral surface 88 of the housing 70. In the embodiment shown, the surface 114 of each drive roller 98 is in contact with the O-ring 90 of the peripheral surface 88. The contact between the drive rollers 98 and the O-ring 90 should be strong enough to create a frictional force between the drive rollers 98 and the O-ring 90 such that as the turret 78 rotates, the drive rollers 98, and thus the roller assemblies 94, rotate within each pocket 92. Accordingly, this frictional force enables O-ring 90 transmits torque sufficient to drive the components.

Referring back to FIG. 4, the lubricating station 82 may be positioned proximate to the turret 78 and may include a lubricant housing 120. As shown, the lubricating station 82 is preferably positioned below the turret 78 and the lubricant housing 120 is spaced apart from the turret 78 a distance to allow the can body to pass therebetween. The lubricant housing 120 preferably includes a lubricant for coating the open end of the can body as the can body passes by the lubricant housing 120. Example lubricants may include wax, oil or any other suitable lubricant. Accordingly, as the turret 78 rotates, the roller assemblies 94 rotate the can bodies within the turret pocket 92, and as the can body passes through the lubricant housing 120, the lubricant will be applied to the entire open end of the rotating can body.

Figure 7:
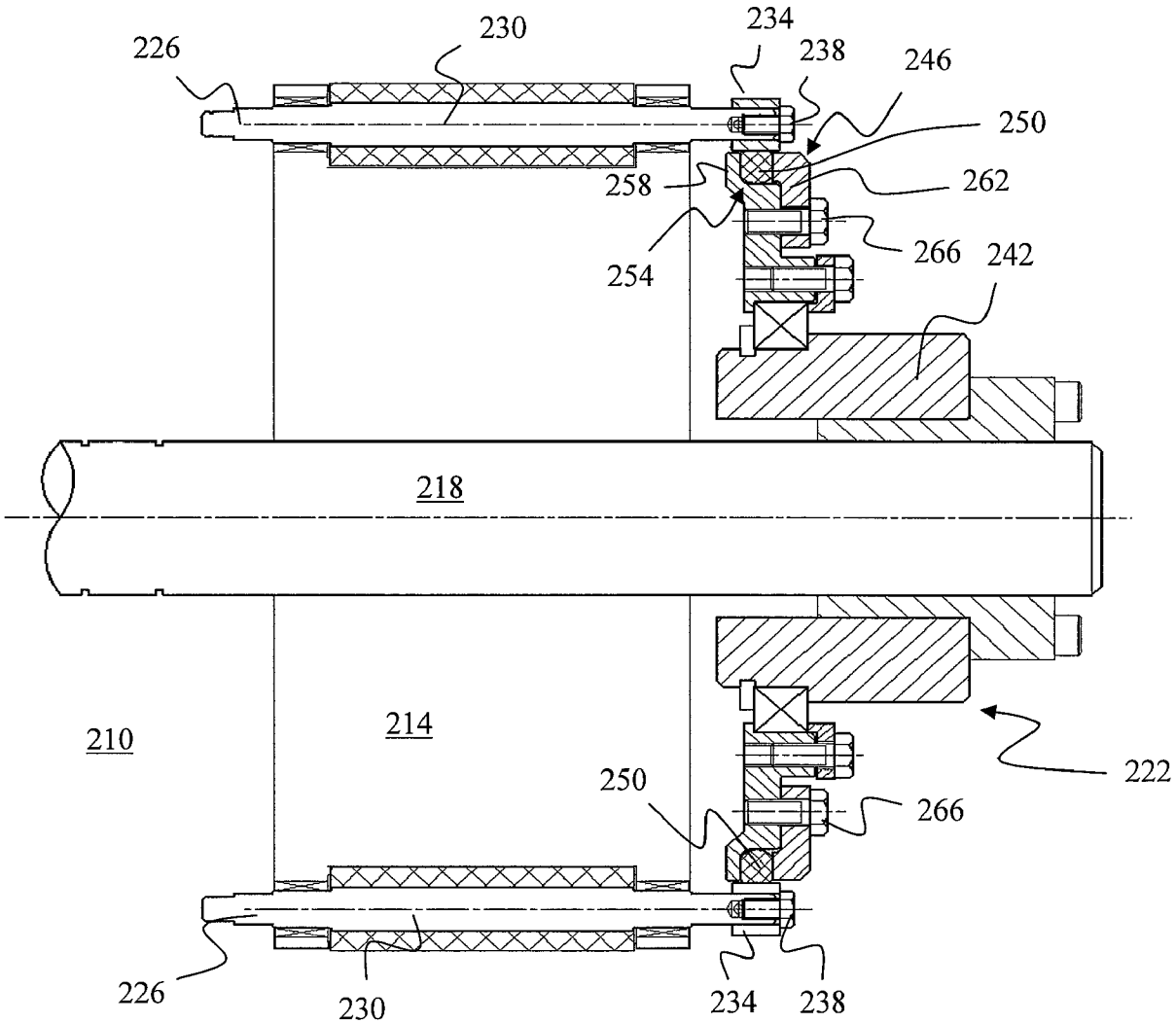
FIG. 7 is a cross-sectional view of a waxer assembly.

In a preferred embodiment, the waxer station may be designed for cost effective maintenance. For example, the O-ring and the drive rollers may be easily replaced. FIG. 7 is a cross-sectional view of an example waxer station having a replaceable O-ring and replaceable drive rollers. As shown, a waxer station 210 includes a turret 214 mounted on a rotating shaft 218 and a housing 222 mounted proximate to the turret 214. The turret 214 includes pockets (not shown) formed therein and roller assemblies 226 rotateably mounted within the pockets. Each roller assembly 226 has a body portion 230 and a drive roller 234 extending from the body portion 230. As shown, each drive roller 234 may be releaseably attached to a respective body portion 230 by a fastener 238. Therefore, if the drive rollers 234 are damaged, the fastener 238 may be removed and the drive rollers 234 can be replaced.

As shown, the housing 222 may be mounted on the shaft 218 proximate to the turret 214. The housing 222 includes a stationary housing body 242 and a peripheral surface 246. The peripheral surface 246 preferably includes an O-ring 250 positioned in a groove 254 formed between an inner wall 258 and an outer wall 262. Both the inner wall 258 and the outer wall 262 extend up from the housing body 242. As shown, the drive rollers 234 of the roller assemblies 226 may contact the O-ring 250. After multiple rotations of the turret 214, the O-ring 250 may become damaged thereby requiring it to be replaced. Accordingly, the outer wall 262 may be removed to allow access to the O-ring 250 so that it can be replaced with a new O-ring 250. To remove the outer wall 262, fasteners 266 are removed. Such a configuration may allow for an easy, quick, and cost effective repair of the waxer station, which was not possible with the gear configuration of the prior art.

The present disclosure illustrates the present invention, but the scope of the present invention is not limited to the particular structure illustrated herein. For just one example, O-rings are disclosed as structure to mutual contact. The present invention is not limited to conventional O-ring structure or materials. In this regard, the present invention encompasses structures that do not have the transverse cross section of conventional o-rings, encompasses materials that are not associated with conventional o-rings, and the like.

What is claimed:

1. A waxer assembly for a can necking machine assembly, the waxer assembly comprising:

a fixed ring having an inner wall and a removable outer wall, a waxer turret mounted on a rotating shaft, the waxer turret including peripheral pockets, each of the pockets are adapted for receiving a can body and comprising a can roller; and a lubricating station positioned proximate to the waxer turret and adapted to lubricate an end of the can bodies as the waxer turret rotates;

wherein (i) each can roller comprises a body portion and a drive roller extending from the body portion, (ii) a contact portion of each body portion is positioned within a respective pocket such that the contact portion is adapted to contact an outer surface of the can body received in the pocket, (iii) each drive roller is in contact with the fixed ring such that as the waxer turret rotates, friction between the drive roller and the fixed ring causes the can roller to rotate, and (iv) removal of the outer wall allows the frictional contact between the drive roller and the fixed ring to be removed.

2. The waxer assembly of claim 1, wherein the fixed ring is a housing, the housing having a peripheral surface and each drive roller is in contact with the peripheral surface of the housing.

3. The waxer assembly of claim 2, wherein the peripheral surface of the housing includes an O-ring and the drive rollers are in contact with the O-ring such that as the waxer turret rotates about the shaft, friction between the drive rollers and the O-ring causes the can rollers to rotate.

4. The waxer assembly of claim 3, wherein the O-ring is made of rubber.

5. The waxer assembly of claim 3, wherein (i) the peripheral surface of the housing includes a groove formed between the inner wall and the outer wall of the housing, and (ii) the O-ring is secured within the groove.

6. The waxer assembly of claim 1, wherein each drive roller is releaseably attached to the body portion of a respective can roller.

7. The waxer assembly of claim 1, wherein each pocket has two can rollers.

8. The waxer assembly of claim 1, wherein the lubricating station includes a wax for lubricating the end of the can bodies as the waxer turret rotates.

9. The waxer assembly of claim 1, wherein the lubricating station includes an oil for lubricating the end of the can bodies as the waxer turret rotates.

10. The waxer assembly of claim 1, wherein the fixed ring is mounted concentric to the shaft.

11. The waxer assembly of claim 1, wherein the fixed ring is mounted on the shaft.

12. An apparatus for rotating a container body, the apparatus comprising:

a stationary housin hg aving an inner wall, a peripheral contact surface and a removable outer wall;

a turret mounted on a rotating shaft proximate to the housing, the turret having a plurality of pockets formed therein; and a roller assembly disposed within each pocket, each roller assembly having a body portion and a drive roller portion, wherein each body portion has a contact portion for contacting a container body received in a respective pocket, and each drive roller portion is in contact with the peripheral contact surface of the housing such that as the turret rotates, friction between the drive rollers and the housing peripheral contact surface causes each roller assembly to rotate, wherein removal of the outer wall provides access to the peripheral contact surface and the drive roller portions to thereby allow the frictional contact between the drive roller portions and the peripheral surface to be removed.

13. The apparatus of claim 12, further comprising a second roller assembly disposed in each pocket.

14. The apparatus of claim 12, wherein the container is a can.

15. The apparatus of claim 12, wherein the peripheral contact surface comprises an O-ring and the drive roller of each roller assembly is in contact with the O-ring such that as the turret rotates, friction between the drive roller and the O-ring causes the roller assembly to rotate.

16. The apparatus of claim 15, wherein the O-ring is made of rubber.

17. The apparatus of claim 15, wherein the O-ring is removeably attached to the housing.

18. The apparatus of claim 12, wherein the apparatus is a waxer assembly for a multi-stage can necking machine.

19. The apparatus of claim 12, wherein each drive roller is removeably attached to a respective body portion.

20. The apparatus of claim 12, wherein the housing is mounted concentric to the shaft.

21. The apparatus of claim 12, wherein the housing is mounted on the shaft.

* * * * *

UNITED STATES PATENT AND TRADEMARK OFFICE

CERTIFICATE OF CORRECTION

PATENT NO. : 7,997,111 B2
APPLICATION NO. : 12/109031
DATED : August 16, 2011
INVENTOR(S) : Richard Mercer and David William Smith It is certified that error appears in the above-identified patent and that said Letters Patent is hereby corrected as shown below:

In the Claims:

Column 7,
Claim 12,
Line 7, delete "housin hg aving" and insert -- housing having --.
Line 19, after "the" delete "housing".

Signed and Sealed this
Eleventh Day of June, 2013

Teresa Stanek Rea
*Acting Director of the United States Patent and Trademark Office*